US011458726B2

(12) United States Patent
Yoshida et al.

(10) Patent No.: US 11,458,726 B2
(45) Date of Patent: Oct. 4, 2022

(54) LIQUID EJECTING APPARATUS

(71) Applicant: SEIKO EPSON CORPORATION, Tokyo (JP)

(72) Inventors: Masahiko Yoshida, Shiojiri (JP); Masashi Kamiyanagi, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/210,581

(22) Filed: Mar. 24, 2021

(65) Prior Publication Data

US 2021/0300019 A1 Sep. 30, 2021

(30) Foreign Application Priority Data

Mar. 25, 2020 (JP) ..... JP2020-054530

(51) Int. Cl.
*B41J 2/045* (2006.01)

(52) U.S. Cl.
CPC ..... *B41J 2/0451* (2013.01); *B41J 2/04586* (2013.01)

(58) Field of Classification Search
CPC ..... B41J 2/0451; B41J 2/04586
See application file for complete search history.

(56) References Cited

U.S. PATENT DOCUMENTS

2016/0271941 A1* 9/2016 Yokoyama ..... B41J 2/04586

FOREIGN PATENT DOCUMENTS

JP H06-270410 A 9/1994

* cited by examiner

*Primary Examiner* — Thinh H Nguyen
(74) *Attorney, Agent, or Firm* — Oliff PLC

(57) ABSTRACT

A liquid ejecting apparatus includes an electrode unit including a first electrode and a second electrode, a determination unit configured to individually determine whether or not a coupling failure of the electrode unit occurs and whether or not liquid exists in a liquid container, a first resistor being provided between the first electrode and the second electrode and having a first resistance value, and a second resistor having a second resistance value that varies depending on an amount of the liquid between the first electrode and the second electrode.

8 Claims, 9 Drawing Sheets

LIQUID EJECTING APPARATUS

The present application is based on, and claims priority from JP Application Serial Number 2020-054530, filed Mar. 25, 2020, the disclosure of which is hereby incorporated by reference herein in its entirety.

BACKGROUND

1. Technical Field

The present disclosure relates to a liquid ejecting apparatus.

2. Related Art

As the related art, there has been known an ink remaining amount detecting device in which two electrodes are provided in a liquid container, a voltage is applied between the electrodes, and a remaining amount of ink in the liquid container is detected by using a resistance value between the electrodes in JP-A-6-270410.

In the technique of the related art, when the resistance value between the electrodes is detected, even in a case in which a coupling failure of the electrodes occurs, the resistance value becomes substantially the same as the resistance value in a case where there is no remaining amount of the ink. This makes it difficult to determine whether or not a coupling failure of the electrodes occurs by using the resistance value between the electrodes. This problem is not limited to the technique for detecting the remaining amount of the ink in the liquid container, and is common to techniques that use two electrodes in order to detect a remaining amount of liquid other than ink.

SUMMARY

According to one aspect of the present disclosure, there is provided a liquid ejecting apparatus configured to eject liquid. The liquid ejecting apparatus includes an electrode unit that is provided in a liquid container configured to contain the liquid and that includes a first electrode and a second electrode, a determination unit configured to individually determine whether or not a coupling failure occurs in the electrode unit and whether or not the liquid exists in the liquid container, a first resistor being provided between the first electrode and the second electrode and having a first resistance value, and a second resistor having a second resistance value that varies depending on an amount of the liquid between the first electrode and the second electrode.

According to another aspect of the present disclosure, there is provided a liquid ejecting apparatus configured to eject liquid. The liquid ejecting apparatus includes an electrode unit that is provided in a liquid container configured to contain the liquid and that includes a first electrode and a second electrode, a determination unit configured to determine whether or not a coupling failure occurs in the electrode unit and whether or not the liquid exists in the liquid container, a first capacitor provided between the first electrode and the second electrode, and a second resistor having a second resistance value that varies depending on an amount of the liquid between the first electrode and the second electrode.

DESCRIPTION OF EXEMPLARY EMBODIMENTS

A. First Embodiment

Figure 1:
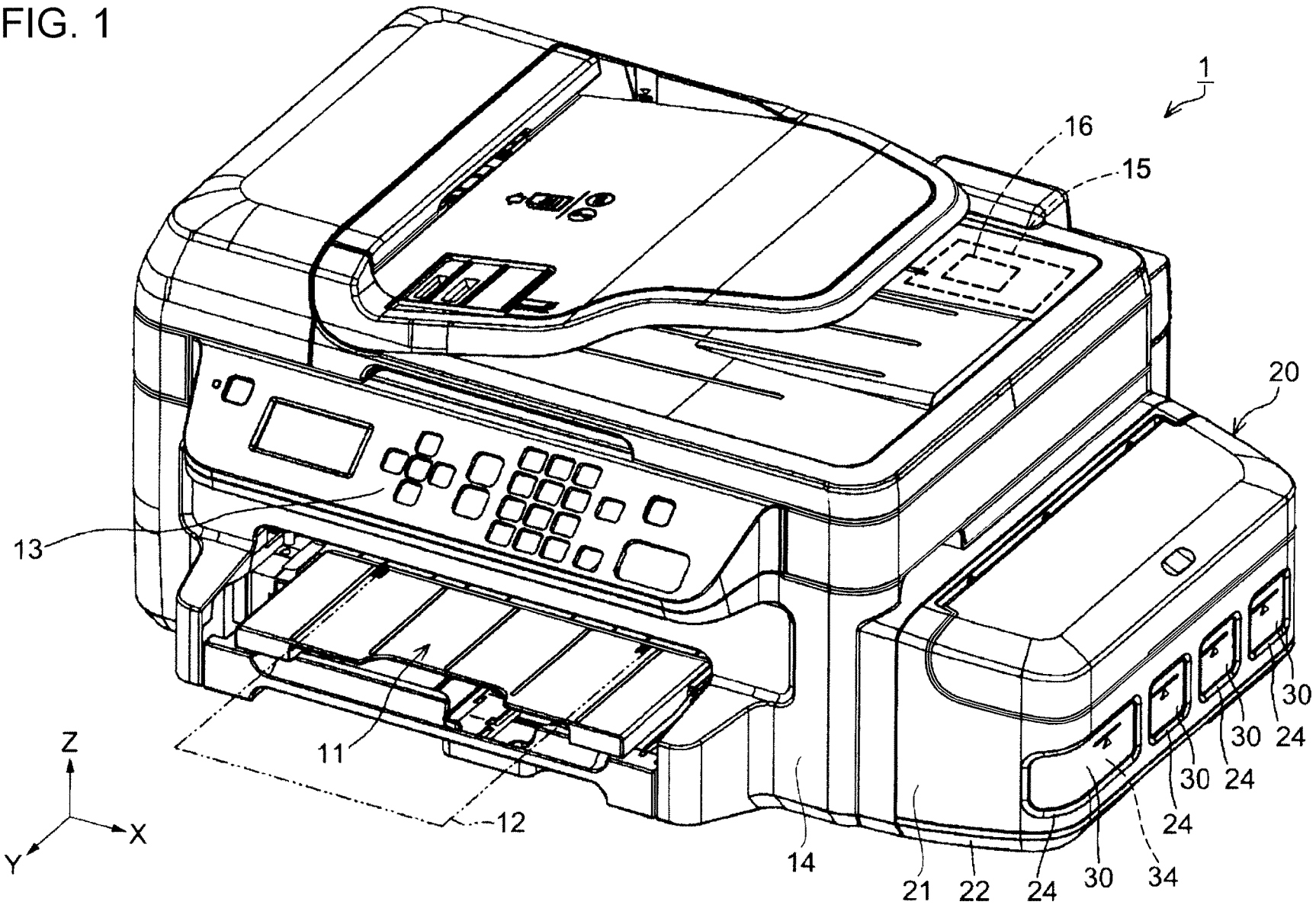
FIG. 1 is an external perspective view of a liquid ejecting apparatus according to a first embodiment.
Figure 2:
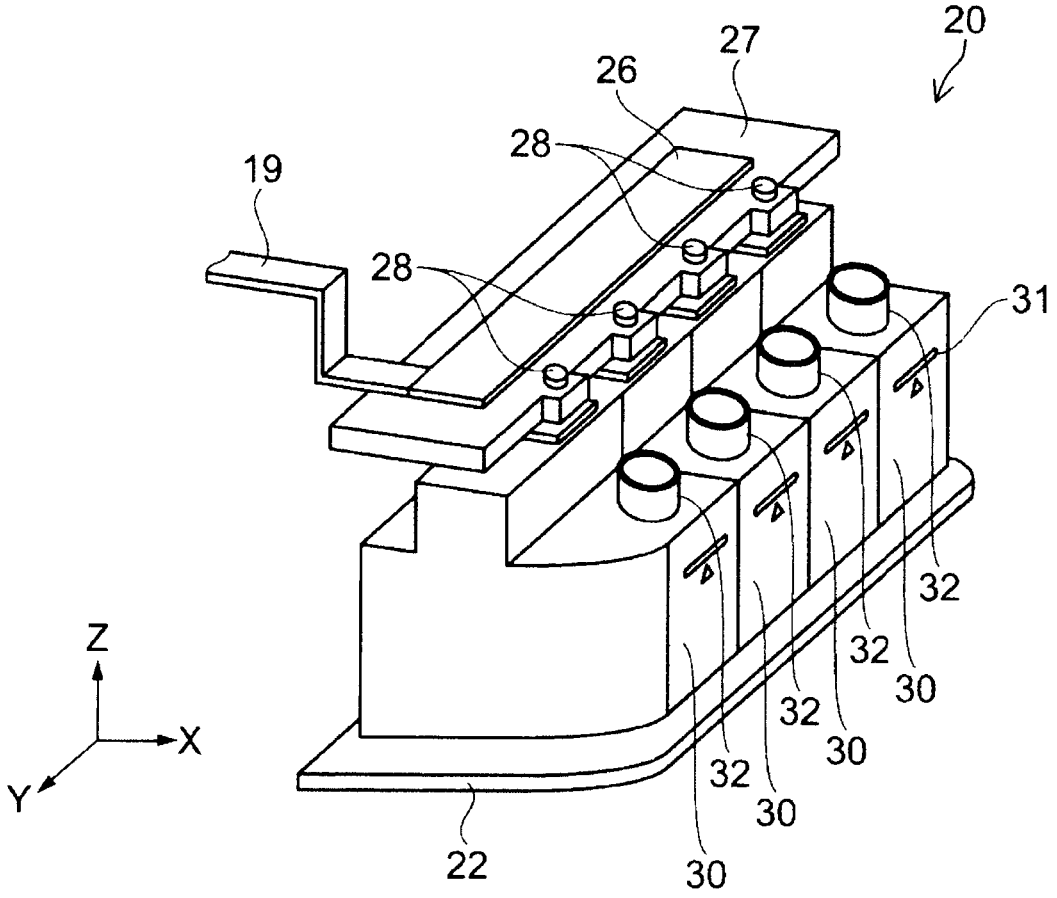
FIG. 2 is a perspective view illustrating a liquid container unit in a state in which a unit cover is removed.

FIG. 1 is an external perspective view of a liquid ejecting apparatus 1 according to a first embodiment. FIG. 2 is a perspective view illustrating a liquid container unit 20 in a state in which a unit cover 21 is removed. In FIG. 1 and FIG. 2, an X axis, a Y axis, and a Z axis that are coordinate axes orthogonal to each other are applied. Similar coordinate axes will be applied in the following figures as necessary. In the present embodiment, the liquid ejecting apparatus 1 is disposed on a horizontal plane parallel to the X axis and the Y axis, and is used. A Z axis direction is a direction along a vertical direction, a +Z axis direction is a vertically upward direction, and a −Z axis direction is a vertically downward direction. A surface in a +Y axis direction of the liquid ejecting apparatus 1 will be referred to as a front surface, and a surface in a −Y axis direction will be referred to as a rear surface.

The liquid ejecting apparatus 1 is an ink jet printer that forms an image by ejecting ink as liquid 34 onto a medium 12 such as a paper sheet. As the liquid 34, pigment-based ink, dye-based ink, or the like can be used. In the present embodiment, the liquid 34 is the pigment-based ink. The liquid ejecting apparatus 1 includes the liquid container unit 20, an operation unit 13, a sheet discharge unit 11, and a case 14. The case 14 configures a part of an outer shell of the liquid ejecting apparatus 1. A mechanism unit (not illustrated) of the liquid ejecting apparatus 1 is housed inside the case 14. The mechanism unit is a mechanism portion that performs a printing operation in the liquid ejecting apparatus 1.

The liquid container unit 20 includes the unit cover 21 and a unit bottom portion 22, and is installed outside the case 14. A plurality of liquid containers 30 can be housed in the liquid container unit 20. The liquid 34 that is used for printing is stored in the liquid container 30, and during the printing of the liquid ejecting apparatus 1, the liquid 34 is supplied from the liquid container 30 to a print head 17.

The liquid container 30 is at least partially formed of a permeable material, and the stored liquid 34 can be visually recognized from the outside of the liquid container 30. The unit cover 21 has a permeable window portion 24 at a position facing the permeable portion of the housed liquid container 30. A user can visually recognize an amount of the liquid 34 in the liquid container 30 through the window portion 24 from the outside of the liquid ejecting apparatus 1.

The operation unit 13 and the sheet discharge unit 11 are disposed at the front surface of the liquid ejecting apparatus 1. The operation unit 13 is provided with a power button, setting buttons, a display panel, and the like. The liquid ejecting apparatus 1 includes a control unit 16 mounted on a control substrate 15. The control unit 16 operates the above-described mechanism unit based on an instruction or the like input from the operation unit 13, and performs printing on the medium 12 by transporting the medium 12, driving the print head 17, and the like. The printed medium 12 is discharged from the sheet discharge unit 11. The control substrate 15 is housed in the case 14.

As illustrated in FIG. 2, the liquid container unit 20 includes the unit bottom portion 22, a substrate support portion 27, and the unit cover 21 surrounding the liquid container 30. The unit bottom portion 22 and the substrate support portion 27 are installed so as to be fixed to the liquid ejecting apparatus 1.

In the liquid container unit 20, a plurality of liquid containers 30 can be aligned and attached so as to face the unit bottom portion 22. In the present embodiment, four liquid containers 30 are attached. The four liquid containers 30 may individually store the liquid 34 having different types such as colors or materials from each other. One of the four liquid containers 30 is larger in size than the others, and can store more liquid 34. For example, the liquid container 30 having a larger size can store black liquid 34 having a high frequency of use, and the other liquid containers 30 can individually store the liquid 34 having respective colors such as yellow, magenta, and cyan.

As illustrated in FIG. 2, the substrate support portion 27 in a vertically upward direction of the unit bottom portion 22 is disposed so as to come into contact with the liquid containers 30 when the liquid containers 30 are aligned and attached to the liquid container unit 20. Therefore, the liquid containers 30 are interposed between the unit bottom portion 22 and the substrate support portion 27, and are attached to the liquid container unit 20.

Further, the liquid containers 30 are fixed to the substrate support portion 27 with screws 28. The substrate support portion 27 includes a circuit substrate 26 on which a circuit including an alternating current generation circuit 40, which will be described later, is mounted. When the liquid container 30 is fixed to the substrate support portion 27, the liquid container 30 is also fixed to the circuit substrate 26. A signal wiring flexible flat cable (FFC) 19 is coupled to the circuit substrate 26 to electrically couple a circuit mounted on the circuit substrate 26 and a circuit mounted on the control substrate 15 of the liquid ejecting apparatus 1. Note that the liquid container 30 comes into contact with the substrate support portion 27 and the circuit substrate 26 in a region deviated from a filling port 32 included in the liquid container 30.

Figure 3:
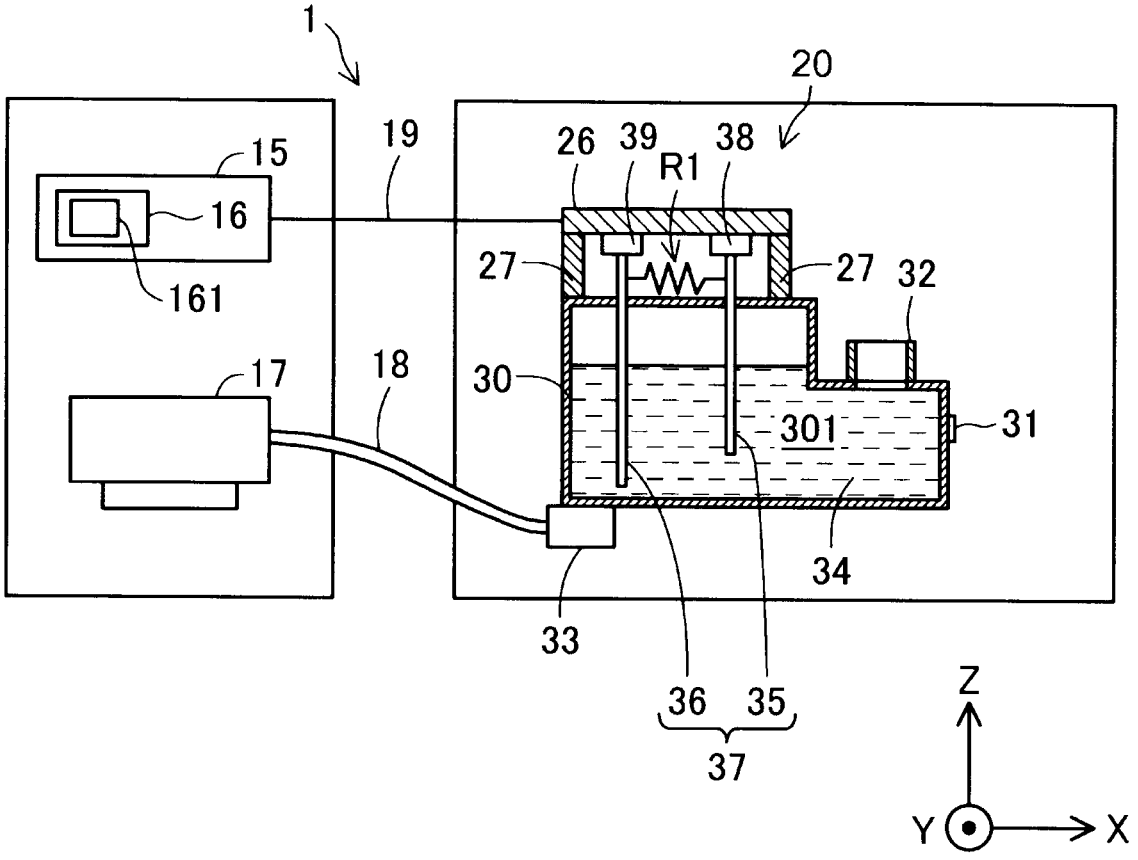
FIG. 3 is a diagram for further describing the liquid ejecting apparatus.

FIG. 3 is a diagram for further describing the liquid ejecting apparatus 1. A configuration of the liquid container 30 will be mainly described with reference to FIG. 2 and FIG. 3. As illustrated in FIG. 3, the liquid container 30 is a container whose inside is hollow, and the liquid 34 can be stored in a liquid containing chamber 301 that is the hollow portion. In addition, the liquid container 30 is provided with the filling port 32 through which the liquid 34 can be filled at a surface of the liquid container 30 in a vertically upward direction. When a remaining amount of the liquid 34 becomes small, the liquid 34 can be refilled from the filling port 32 to the liquid container 30. Normally, a cap member (not illustrated) is air-tightly attached to an opening of the filling port 32. A user of the liquid ejecting apparatus 1 can replenish the liquid 34 in the liquid container 30 through the filling port 32 by detaching the cap member.

Each liquid container 30 is formed with an at least partially permeable outer wall. In the present embodiment, a part of the outer wall in the X axis direction is permeable. A mark 31, illustrated in FIG. 2, serving as a rough indication of the remaining amount is provided at the outer wall surface. The user can recognize the remaining amount by using the mark 31 as a sign.

As illustrated in FIG. 3, the liquid container 30 includes a liquid supply unit 33, an electrode unit 37, and a first resistor R1. The liquid supply unit 33 sends the liquid 34 contained in the liquid container 30 to the print head 17. The electrode unit 37 is used to determine the remaining amount of the liquid in the liquid container 30. The electrode unit 37 includes a first electrode 35 and a second electrode 36. When the liquid container 30 is interposed between the unit bottom portion 22 and the substrate support portion 27 and is attached to the liquid container unit 20, the first electrode 35 and the second electrode 36 that protrude to the outside of the liquid container 30 are disposed so as to come into contact with the circuit substrate 26 disposed at the substrate support portion 27.

Each of the first electrode 35 and the second electrode 36 has a rod-like shape extending from the outside of the liquid container 30 to the liquid containing chamber 301. The first electrode 35 and the second electrode 36 are formed of conductive members, which are stainless steel in the present embodiment. A length of the first electrode 35 is shorter than a length of the second electrode 36. The second electrode 36 extends closer to a bottom portion of the liquid containing chamber 301 than the first electrode 35. Accordingly, when at least the liquid 34 is filled to the extent that the liquid containing chamber 301 is filled, both electrodes of the first electrode 35 and the second electrode 36 are immersed in the liquid 34. After that, when the printing is performed and the amount of the liquid is reduced by consuming the liquid 34, the first electrode 35 is exposed to the outside of the liquid 34, and only the second electrode 36 is immersed in the liquid 34.

As described above, the liquid containers 30 are interposed between the unit bottom portion 22 and the substrate support portion 27, and are attached to the liquid container unit 20. Further, the circuit substrate 26 is disposed, on the substrate support portion 27, so as to face and be able to come into contact with the first electrode 35 and the second electrode 36 of the liquid container 30. The circuit substrate 26 is formed with a first terminal 38 and a second terminal 39 at positions respectively facing the first electrode 35 and the second electrode 36. Accordingly, when the liquid container 30 is attached to the liquid container unit 20, the first electrode 35 and the first terminal 38 come into contact with each other and are electrically coupled to each other, and the second electrode 36 and the second terminal 39 come into contact with each other and are electrically coupled to each other.

Additionally, as illustrated in FIG. 2, by fixing the substrate support portion 27 and the liquid container 30 to each other with the screw 28, the first electrode 35 is crimped to the first terminal 38, and the second electrode 36 is crimped to the second terminal 39. Therefore, the respective electrical coupling between the electrodes 35 and 36 and the terminals 38 and 39 is reliably formed. Further, the circuit mounted on the circuit substrate 26 and the circuit mounted on the control substrate 15 of the liquid ejecting apparatus 1 are coupled to each other through the signal wiring FFC 19. Since the circuit mounted on the control substrate 15 includes the control unit 16, the circuit on the circuit substrate 26 can mutually communicate with the control unit 16. It should be noted that the electrical coupling between each of the first electrode 35 and the second electrode 36 and the circuit substrate 26 is not limited to the above. For example, the first electrode 35 and the second electrode 36 may be electrically coupled to the circuit substrate 26 by using signal lines and connectors. Specifically, one end of a first signal line is attached to the first electrode 35 by soldering or the like, and the other end of the first signal line is attached to a connector. In addition, one end of a second signal line is attached to the second electrode 36 by soldering or the like, and the other end of the second signal line is attached to a connector. The connectors are coupled to a coupling unit of the circuit substrate 26, so that the first electrode 35 and the second electrode 36 are electrically coupled to the circuit substrate 26.

The first resistor R1 is provided on an electric circuit between the first electrode 35 and the second electrode 36, and has a first resistance value RV1. The first resistor R1 is electrically coupled to the first electrode 35 and the second electrode 36. Specifically, in the present embodiment, one end of the first resistor R1 is coupled to a portion of the first electrode 35 positioned outside the liquid containing chamber 301, and the other end of the first resistor R1 is coupled to a portion of the second electrode 36 positioned outside the liquid containing chamber 301, so that the first resistor R1 is provided between the first electrode 35 and the second electrode 36.

The liquid 34 in the liquid containing chamber 301 functions as a second resistor R2. The liquid 34 is electrically conductive and has a second resistance value RV2 that varies depending on the amount of the liquid 34 between the first electrode 35 and the second electrode 36. For this reason, when both electrodes of the first electrode 35 and the second electrode 36 are immersed in the liquid 34, the first electrode 35 and the second electrode 36 are electrically coupled to each other via the liquid 34.

The first resistor R1 and the second resistor R2 are coupled to the first electrode 35 and the second electrode 36 in a parallel manner. The first resistance value RV1 is larger than the maximum value of the second resistance value RV2. In the present embodiment, the first resistance value RV1 is 50 kΩ.

The control unit 16 includes a determination unit 161 that can individually determine whether or not a coupling failure caused by disconnection of the electrode unit 37 or the like occurs and whether or not the liquid exists in the liquid container 30.

The liquid supply unit 33 is provided in a portion corresponding to a lower portion of the liquid container 30 in an attached state in which the liquid container 30 is used. The liquid 34 filled from the filling port 32 into the liquid container 30 is stored in the liquid containing chamber 301 and is sent out from the liquid supply unit 33 to the outside. On the other hand, a tube 18 serving as a liquid transport path is fixed and disposed to the liquid ejecting apparatus 1. One end of the tube 18 is coupled to the liquid supply unit 33, and the other end of the tube 18 is coupled to the print head 17. As a result, the liquid 34 in the liquid container 30 is transported to the print head 17 through the tube 18 and is used for the printing.

The liquid container unit 20 is configured such that the liquid supply unit 33 is joined to the tube 18 when the liquid container 30 is attached to the liquid container unit 20.

As described above, as for the liquid container 30, the liquid supply unit 33 is attached to the tube 18, and the first electrode 35 and the second electrode 36 are electrically coupled to the first terminal 38 and the second terminal 39 on the circuit substrate 26. Accordingly, the liquid 34 stored in the liquid containing chamber 301 of the liquid container 30 is in a state of being used in the liquid ejecting apparatus 1.

Figure 4:
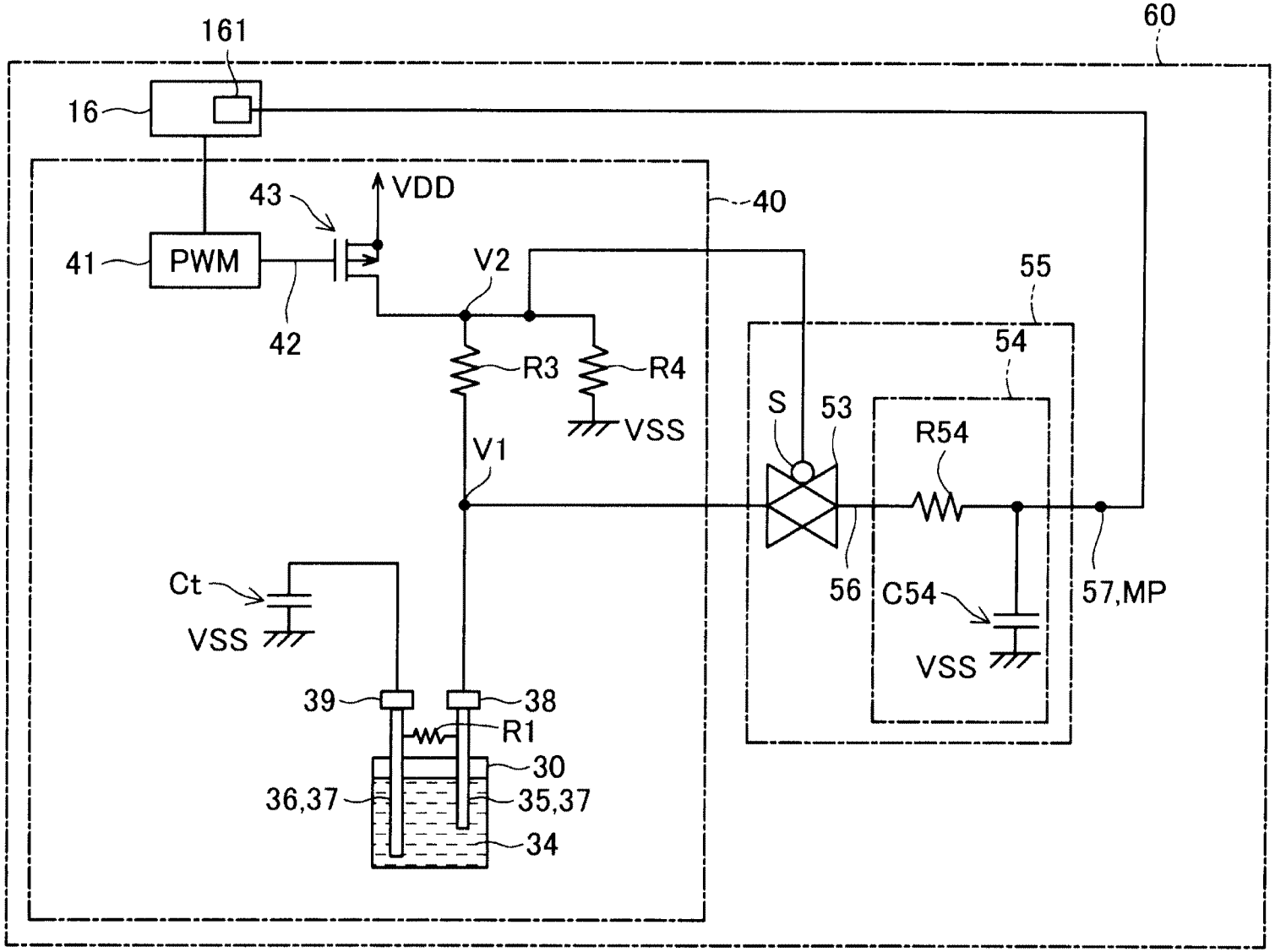
FIG. 4 is a diagram illustrating an example of a liquid detection mechanism.
Figure 5:
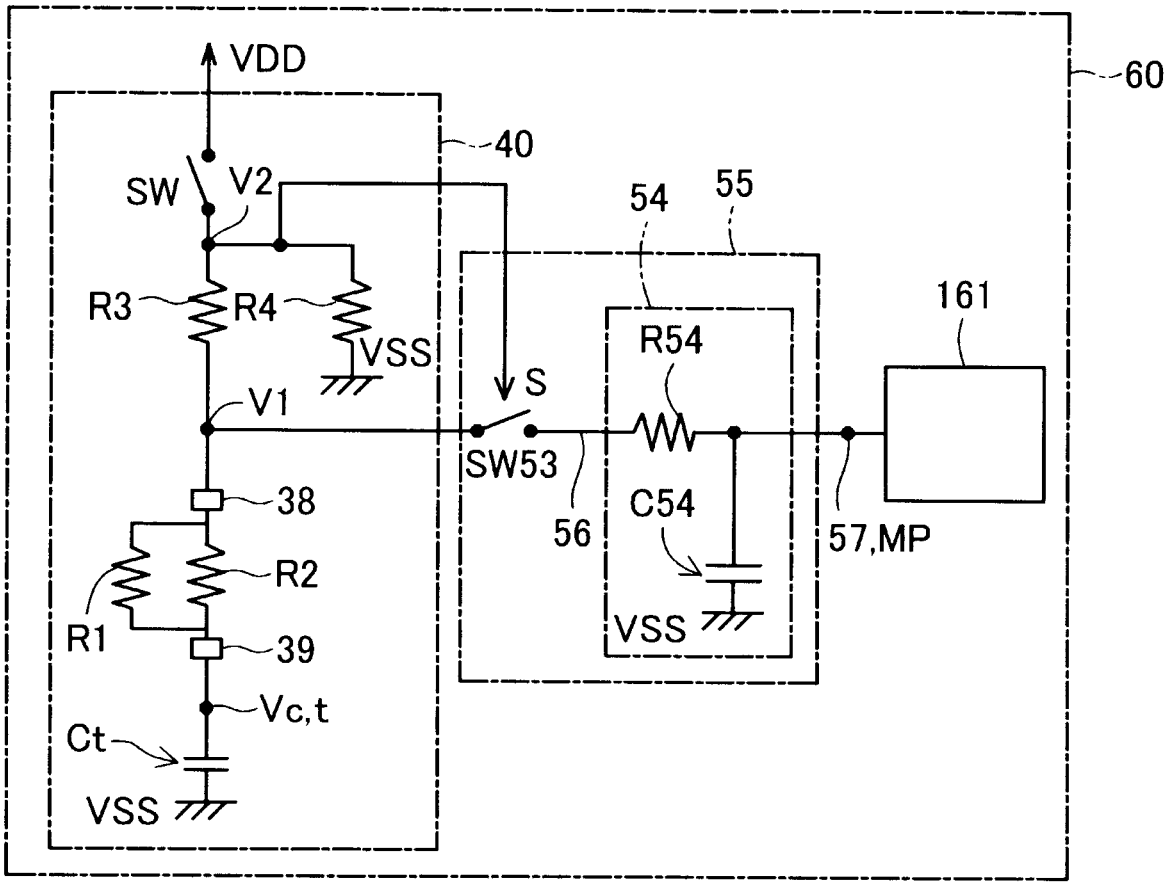
FIG. 5 is an equivalent circuit diagram of the liquid detection mechanism in FIG. 4.
Figure 6:
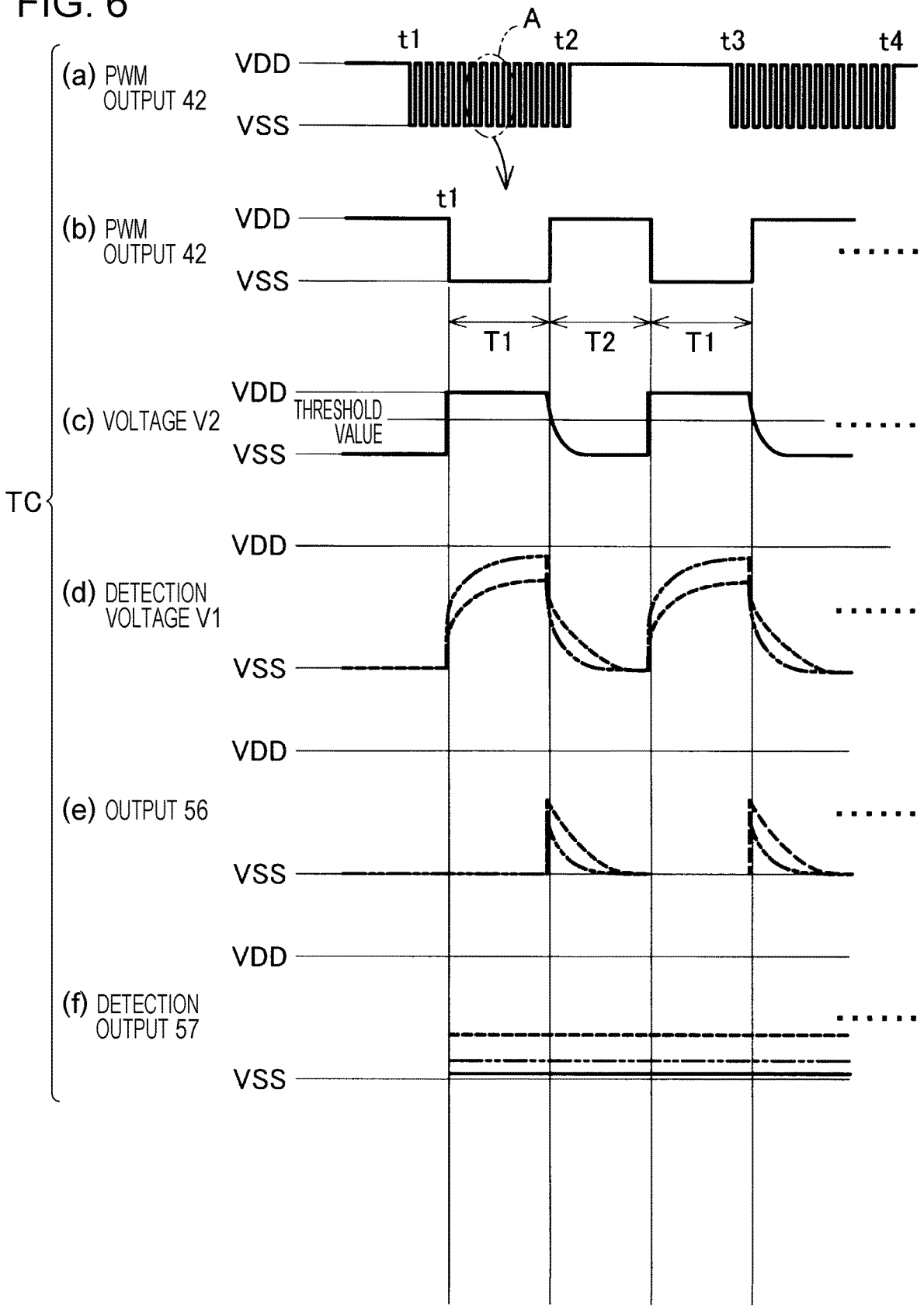
FIG. 6 is a timing chart illustrating an example of an operation of the liquid detection mechanism.

Next, a liquid detection mechanism 60 will be described with reference to FIG. 4 to FIG. 6. FIG. 4 is a diagram illustrating an example of the liquid detection mechanism 60. FIG. 5 is an equivalent circuit diagram of the liquid detection mechanism 60 in FIG. 4. FIG. 6 is a timing chart illustrating an example of an operation of the liquid detection mechanism 60. Note that, in FIG. 4, VDD represents a potential at a high potential side of a power supply for operating the liquid detection mechanism 60. In addition, VSS represents a potential at a low potential side of the power supply, and is a ground that is a reference potential. In the following drawings, the same reference signs will be used.

As illustrated in FIG. 4, the liquid detection mechanism 60 includes an alternating current generation circuit 40, a detection output generation unit 55, and a determination unit 161. The alternating current generation circuit 40 has the following elements:

a) The electrode unit 37 including the first electrode 35 and the second electrode 36;

b) A periodic signal generation unit 41 that generates a predetermined periodic signal;

c) A p-channel FET 43 as a predetermined potential supply unit;

d) A third resistor R3 whose one end is coupled to the first electrode 35;

e) The first terminal 38 that couples the first electrode 35 and the third resistor R3;

f) A fourth resistor R4 that configures a reference potential supply unit;

g) A capacitor Ct coupled between the second electrode 36 and a reference potential;

h) The second terminal 39 coupling the second electrode 36 and the capacitor Ct to each other; and i) The first resistor R1 coupled to the first electrode 35 and the second electrode 36.

Further, the detection output generation unit 55 includes the following elements:

j) An analog switch 53 including a control terminal S; and k) A resistor R54 and a capacitor C54 that configure an integration circuit 54.

The liquid detection mechanism 60 outputs a detection output 57 by generating a detection voltage V1 in the alternating current generation circuit 40 and shaping a waveform of the detection voltage V1 in the detection output generation unit 55. The determination unit 161 detects the detection output 57 at a measurement point MP that is a point after the waveform generation. Here, the detection output 57 is a voltage at the measurement point MP. The measurement point MP is provided between the determination unit 161 and both the first resistor R1 and the second resistor R2 on the electric circuit. More specifically, the measurement point MP is positioned between the detection output generation unit 55 and the determination unit 161 on the electric circuit.

The above-described respective elements of the alternating current generation circuit 40 are coupled as illustrated in FIG. 4 to form the alternating current generation circuit 40. Specifically, a source terminal of the p-channel FET 43 is coupled to VDD. A gate terminal of the p-channel FET 43 is coupled to a PWM output 42 that is an output of the periodic signal generation unit 41. A drain terminal of the p-channel FET 43 is coupled to the third resistor R3 and the fourth resistor R4. Here, a coupling point of the drain terminal, the third resistor R3, and the fourth resistor R4 is referred to as a second coupling point, and a potential of the second coupling point is represented as V2. One end of the third resistor R3 is coupled to the first electrode 35 via the first terminal 38, and the other end of the third resistor R3 is coupled to the drain terminal. One end of the fourth resistor R4 is coupled to VSS, and the other end of the fourth resistor R4 is coupled to the drain terminal. The capacitor Ct is coupled to the second electrode 36. One end of the capacitor Ct is coupled to VSS, and the other end of the capacitor Ct is coupled to the second electrode 36 via the second terminal 39.

Note that the periodic signal generation unit 41 is configured with a signal generator that can generate periodic signals at various timings based on control of the control unit 16 of the liquid ejecting apparatus 1. Here, the alternating current generation circuit 40 can be configured by, for example, setting a resistance value of the third resistor R3 to 10 kΩ, setting a resistance value of the fourth resistor R4 to 1 kΩ, and setting a capacitance of the capacitor Ct to 1 nF.

The detection output generation unit 55 transmits the detection voltage V1 generated in the alternating current generation circuit 40 to the integration circuit 54 at a specific timing by the analog switch 53 to smooth the detection voltage by the integration circuit 54. The smoothed output of the integration circuit 54 serves as the detection output 57 detected by the determination unit 161. As illustrated in FIG. 4, the control terminal S of the analog switch 53 is coupled to the second coupling point in the alternating current generation circuit 40, and the detection voltage V1 is transmitted to the integration circuit 54 based on the potential V2 at the second coupling point. One of the input and output terminals of the analog switch 53 is coupled to the first coupling point in the alternating current generation circuit 40. As described above, the first coupling point is a coupling point between the first electrode 35 and the third resistor R3, and a potential of the first coupling point is the detection voltage V1. The other of the input and output terminals of the analog switch 53 is coupled to one end of the resistor R54 that is an input of the integration circuit 54. The other end of the resistor R54 is coupled to the other end of the capacitor C54 whose one end is coupled to VSS, and the integration circuit 54 is configured by using the resistor R54 and the capacitor C54. A potential at a coupling point between the resistor R54 and the capacitor C54 serves as the detection output 57 that is an output of the integration circuit 54 and an output of the detection output generation unit 55. It should be noted that the detection output generation unit 55 can be configured by setting a resistance value of the resistor R54 to 66 kΩ, and setting a capacitance of the capacitor C54 to 0.01 μF, for example.

FIG. 6 is a timing chart TC illustrating an example of an operation of the liquid detection mechanism 60 and illustrates the voltage of the detection voltage V1 and the voltage of the detection output 57 based on the timing chart TC. Both the PWM output 42 illustrated in (a) in FIG. 6 and the PWM output 42 illustrated in (b) in FIG. 6 represent the output 42 of the periodic signal generation unit 41. The PWM output 42 illustrated in (b) in FIG. 6 is represented as a diagram in which a part of the PWM output 42 illustrated in (a) in FIG. 6 is temporally enlarged and illustrated. Specifically, the PWM output 42 illustrated in (b) in FIG. 6 is represented as a diagram in which a range A surrounded by the dashed-two dotted line is enlarged. (c) in FIG. 6 illustrates the potential V2 at the second coupling point that controls an operation of the analog switch 53. (d) in FIG. 6 illustrates the detection voltage V1 with respect to the liquid 34 by using a broken line, and illustrates the detection voltage V1 when there is no liquid 34 by using a dashed-two dotted line. (e) in FIG. 6 illustrates an output 56 of the analog switch 53. (f) in FIG. 6 illustrates the detection output 57.

The periodic signal generation unit 41 is controlled to start and stop oscillating a periodic signal by a control signal from the control unit 16. The periodic signal generation unit 41 outputs a signal that periodically repeats a first period T1 that is at a VSS level and a second period T2 that is at a VDD level as the PWM output 42 during a period of receiving an instruction for the oscillation from the control unit 16. In (a) in FIG. 6, a period from t1 to t2 and a period from t3 to t4 are the periods of receiving the instruction for the oscillation from the control unit 16. Each period is referred to as a periodic signal interval. A length of the interval is set to a period of time during which the detection output 57 can be acquired to the extent that the detection unit can determine information of ink for one liquid container. For example, the PWM output 42 periodically repeats the first period T1 and the second period T2 in the periodic signal interval at the same duty ratio of 50%.

When the periodic signal generation unit receives a signal for stopping the oscillation from the control unit 16 in a period from t2 to t3, the periodic signal generation unit stops the oscillation and outputs a signal at the VDD level as the output 42.

In the alternating current generation circuit 40 illustrated in FIG. 4, on/off of the p-channel FET 43 is controlled based on the PWM output 42. Specifically, the p-channel FET 43 is turned on when the PWM output 42 is in the first period T1, and is turned off when the PWM output 42 is in the second period T2. As a result, the drain terminal becomes VDD in the first period T1, and the drain terminal becomes in a high-impedance state in the second period T2. Therefore, in the first period T1, the first electrode 35 is coupled to VDD via the third resistor R3, and in the second period T2, the coupling becomes in a state of being cut off. As described above, the p-channel FET 43 functions as the predetermined potential supply unit.

In the first period T1, since the fourth resistor R4 is also coupled to VDD, a current flows from VDD to VSS via the fourth resistor R4. Since the current increases current consumption of the alternating current generation circuit 40, in order to prevent the increase in current consumption, a value of the fourth resistor R4 may be made larger as much as possible.

As described above, in a state in which both electrodes of the first electrode 35 and the second electrode 36 are immersed in the liquid 34, both the electrodes are brought into a conductive state via the combined resistance of the first resistor R1 and the second resistor R2 generated by the liquid 34. Therefore, in the first period T1, a current flows through a path of VDD, the p-channel FET 43, the third resistor R3, the first terminal 38, the first electrode 35, the liquid 34, the first resistor R1, the second electrode 36, the second terminal 39, the capacitor Ct, and VSS. When the current flows through the path, the capacitor Ct is charged. Therefore, a potential of the capacitor Ct gradually approaches VDD, and as illustrated in (d) in FIG. 6, the detection voltage V1 gradually approaches VDD in the first period T1.

Next, in the second period T2, the p-channel FET 43 is turned off. This eliminates the current flowing from VDD, and thus, the potential of the charged capacitor Ct becomes the highest in the circuit system. As a result, a current flows through a path of the capacitor Ct, the second terminal 39, the second electrode 36, the liquid 34, the first resistor R1, the first electrode 35, the first terminal 38, the third resistor R3, the fourth resistor R4, and VSS. Accordingly, in the second period T2, charges charged in the capacitor Ct in the first period T1 are discharged. Therefore, the fourth resistor R4 functions as a reference potential supply unit that couples the first electrode 35 to VSS via the third resistor R3. At this time, the potential of the capacitor Ct gradually decreases according to the discharge. Thus, as illustrated in (d) in FIG. 6, the detection voltage V1 gradually approaches VSS in the second period T2.

As apparent from the above description, current flowing directions of the current flowing through the liquid 34 in the first period T1 and the current flowing through the liquid 34 in the second period T2 are opposite to each other. That is, in the periodic signal interval in which the PWM output 42 periodically repeats the first period T1 and the second period T2, an alternating current flows in the liquid 34.

Next, an operation of the detection output generation unit 55 illustrated in FIG. 4 will be described. The potential V2 that controls the analog switch 53 changes as illustrated in (c) in FIG. 6, based on the PWM output 42 illustrated in (b) in FIG. 6. Specifically, when the PWM output 42 is at the VDD level, the p-channel FET 43 is turned off, and thus the potential V2 approaches VSS via the fourth resistor R4. On the other hand, when the PWM output 42 is at the VSS level, the p-channel FET 43 is turned on, and thus the potential V2 becomes VDD. The analog switch 53 is configured to be turned off when the potential V2 exceeds a predetermined threshold value and approaches VDD and is configured to be turned on when the potential V2 becomes below the predetermined threshold value and approaches VSS. Therefore, in the second period T2 in which the potential V2 approaches VSS, the detection voltage V1 is transmitted to the output 56 of the analog switch 53. On the other hand, in the first period T1 in which the potential V2 becomes VDD, the transmission of the detection voltage V1 is blocked, and therefore, the output 56 is brought into an indefinite state. (e) in FIG. 6 illustrates the state, and specifically illustrates that the detection voltage V1 illustrated in (d) in FIG. 6 appears at the output 56 in the second period T2.

As described above, the detection voltage V1 is cut out based on the change in potential V2, and becomes the output 56 illustrated in (e) in FIG. 6 of the analog switch 53. The output 56 is then transmitted to the integration circuit 54 and smoothed to generate the detection output 57. As a result, as illustrated in (f) in FIG. 6, the stable detection output 57 is generated. Specifically, a voltage at the detection output 57 when there is no liquid in the liquid containing chamber 301 is lower than the minimum voltage at the detection output 57 when the liquid exists in the liquid containing chamber 301. Note that the second resistance value RV2 of the liquid 34 varies depending on the remaining amount of the liquid in the liquid containing chamber 301. Accordingly, the voltage of the detection output 57 when the liquid exists in the liquid containing chamber 301 also varies. Here, the phrase "there is no liquid in the liquid containing chamber 301" refers to a state in which a liquid surface of the liquid containing chamber 301 reaches a lower side than the first electrode 35.

Additionally, as illustrated in (f) in FIG. 6 by using a solid line, the potential of the detection output 57 when a coupling failure occurs due to disconnection or the like between the first electrode 35 and the second electrode 36 and the circuit is opened is lower than the potential of the detection output 57 when there is no liquid in the liquid containing chamber 301.

Next, a behavior of the alternating current generation circuit 40 will be described in more detail with reference to FIG. 5 and FIG. 7. In FIG. 5, SW is a switch indicating the p-channel FET 43. SW53 is a switch indicating the analog switch 53.

Figure 7:
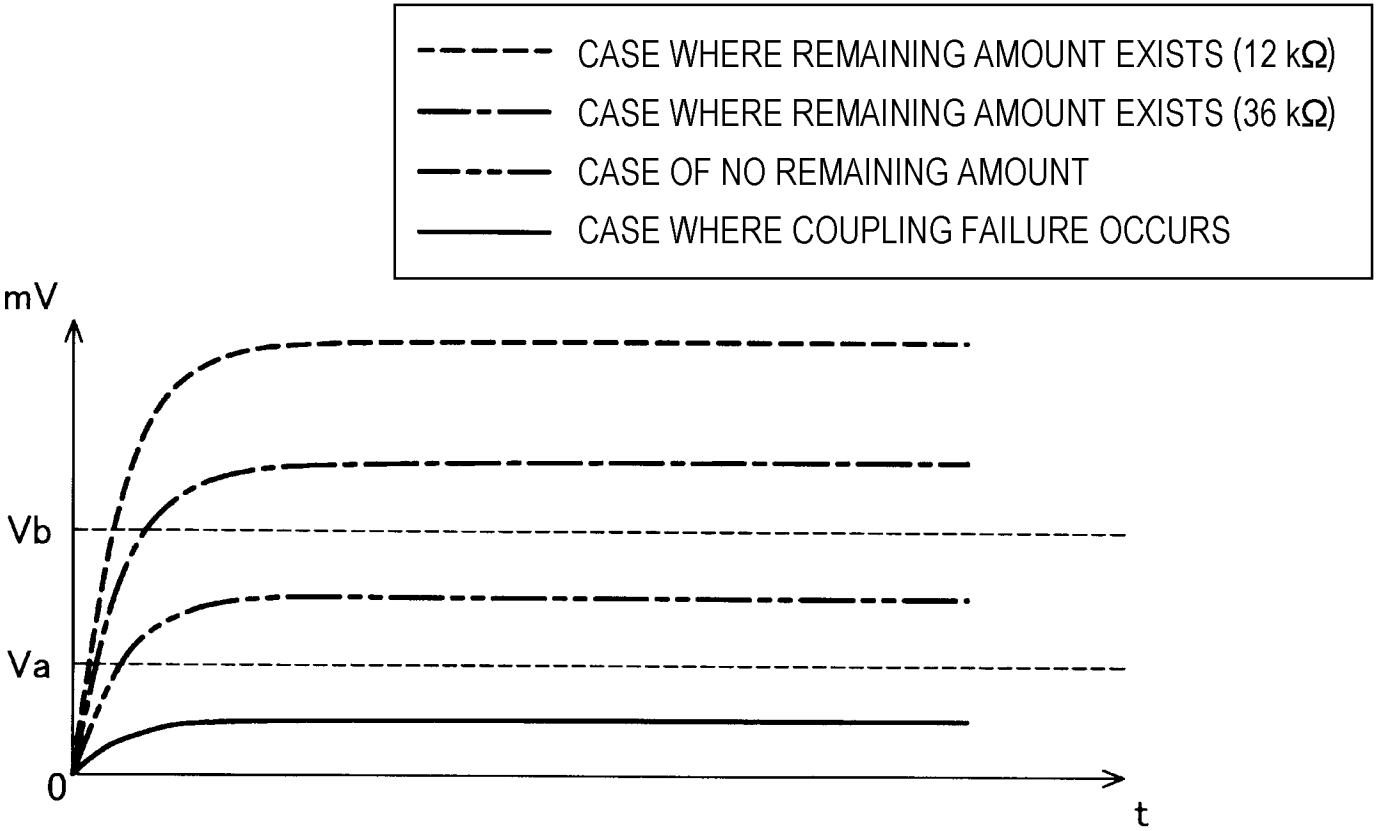
FIG. 7 is a diagram illustrating a simulation result of a detection output at a measurement point.

FIG. 7 is a diagram illustrating a simulation result of the detection output 57 at the measurement point MP. In FIG. 7, the vertical axis represents a voltage, and the horizontal axis represents an elapsed time. As illustrated in FIG. 7, the detection output 57 that is a voltage at the measurement point MP in a case where the remaining amount exists, that is, in a state where the first electrode 35 and the second electrode 36 are immersed in the liquid 34 is higher than that in a case of no remaining amount, that is, in a state where the liquid level is at a lower side than the first electrode 35. In the case where the remaining amount exists, the resistance when the second resistance value RV2 of the liquid 34 takes the maximum value is 36 kΩ. Further, the detection output 57 that is a voltage at the measurement point MP in the case of no remaining amount is higher than that in a case where a coupling failure of the electrode unit 37 occurs.

Based on the simulation result, a first threshold value Va and a second threshold value Vb are determined in advance. The first threshold value Va is a threshold value that is used to determine whether or not a coupling failure of the electrode unit 37 occurs. The second threshold value Vb is a threshold value that is used to determine whether or not the liquid exists in the liquid container 30. The second threshold value Vb is larger than the first threshold value Va. The first threshold value Va and the second threshold value Vb are stored, for example, in a memory in the control unit 16. The determination unit 161 compares the detection output 57 with the first threshold value Va to determine whether or not a coupling failure of the electrode unit 37 occurs. Specifically, the determination unit 161 determines that the coupling failure has occurred when the detection output 57 is smaller than the first threshold value Va, and determines that the coupling failure has not occurred when the detection output 57 is larger than the first threshold value Va. Also, the determination unit 161 compares the detection output 57 with the second threshold value Vb to determine whether or not the liquid exists in the liquid container 30. Specifically, the determination unit 161 determines that the liquid exists in the liquid container 30 when the detection output 57 is larger than the second threshold value Vb, and determines that there is no liquid in the liquid container 30 when the detection output 57 is smaller than the second threshold value Vb and is larger than the first threshold value Va. The determination whether or not the coupling failure occurs is performed, for example, when the liquid 34 is refilled from the filling port 32 of the liquid container 30 or before the liquid ejecting apparatus 1 is shipped. Note that the determination whether or not the liquid exists is performed at a predetermined timing, for example, at the end of a printing job or the like.

According to the first embodiment, by providing the first resistor R1 between the first electrode 35 and the second electrode 36, the resistance value between the first electrode 35 and the second electrode 36 can be made different between a case where the amount of the liquid decreases to the extent lower than the first electrode 35 and a case where the coupling failure of the electrode unit 37 occurs. Accordingly, the determination unit 161 can determine whether or not the coupling failure occurs and whether or not the liquid exists according to the difference in resistance value between the first electrode 35 and the second electrode 36. Specifically, the detection output 57 that is the voltage at the measurement point MP also changes when the resistance value between the first electrode 35 and the second electrode 36 changes. Accordingly, the determination unit 161 can determine whether or not the coupling failure of the electrode unit 37 occurs by comparing the voltage at the measurement point MP with the first threshold value Va, and can determine whether or not the liquid exists by comparing the voltage at the measurement point MP with the second threshold value Vb. Further, when the coupling failure of the electrode unit 37 is determined, it is not necessary to dispose another element, for example, a further dummy resistor, and thus a determination period of time can be shortened. Alternatively, since it is not necessary to consider a space in which another element is disposed, the degree of freedom in design of the liquid ejecting apparatus 1 is improved.

Also, in the first embodiment, the first resistance value RV1 is larger than the maximum value of the second resistance value RV2. Accordingly, the resistance values RV1 and RV2 between the first electrode 35 and the second electrode 36 can be made more largely different between the case where the coupling failure occurs in the electrode unit 37 and the case where the amount of the liquid becomes small. Accordingly, the determination unit 161 can accurately determine whether or not the coupling failure of the electrode unit 37 occurs and whether or not the liquid exists according to the difference in resistance value between the first electrode 35 and the second electrode 36.

Additionally, according to the first embodiment described above, the liquid container 30 has the filling port 32. Thereby, even when the liquid ejecting apparatus 1 is used for a long period of time, such as when the liquid is refilled from the filling port 32, the determination unit 161 can accurately determine whether or not the coupling failure occurs and whether or not the liquid exists.

B. Second Embodiment

Figure 8:
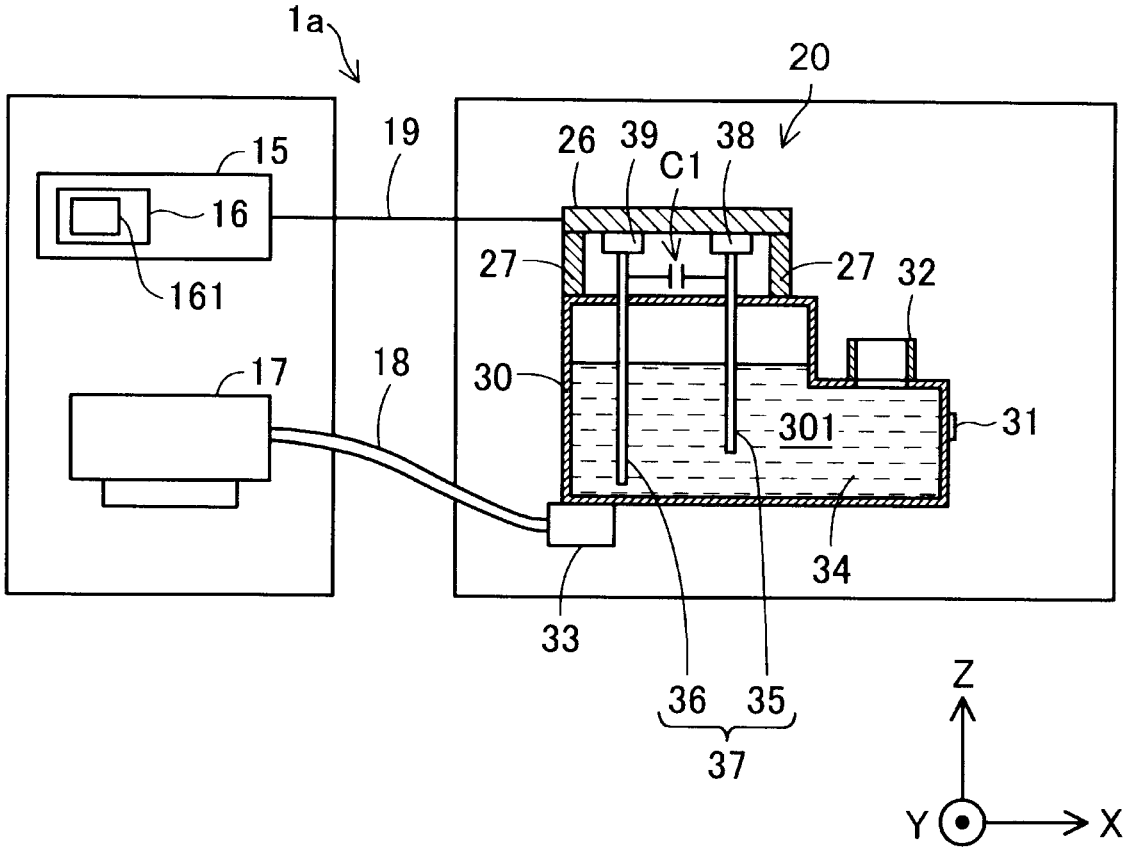
FIG. 8 is a diagram illustrating a liquid ejecting apparatus according to a second embodiment.

FIG. 8 is a diagram illustrating a liquid ejecting apparatus 1*a* according to a second embodiment. A difference between the liquid ejecting apparatus 1*a* and the liquid ejecting apparatus 1 illustrated in FIG. 3 is in that the liquid ejecting apparatus 1*a* includes a first capacitor C1 instead of the first resistor R1. In the liquid ejecting apparatus 1*a*, since the other configurations are similar to those of the first embodiment, similar configurations are denoted by the same reference signs, and the description thereof will be omitted.

Similarly to the first resistor R1 of the first embodiment, the first capacitor C1 is provided between the first electrode 35 and the second electrode 36. The first capacitor C1 is electrically coupled to the first electrode 35 and the second electrode 36. The first capacitor C1 and the second resistor R2 configured by the liquid 34 are coupled to the first electrode 35 and the second electrode 36 in a parallel manner. A capacitance of the first capacitor C1 is, for example, 220 pF. The determination unit 161 detects, on the electric circuit, the detection output 57 that is a voltage at the measurement point MP provided between the determination unit 161 and both the second resistor R2 and the first capacitor C1.

Figure 9:
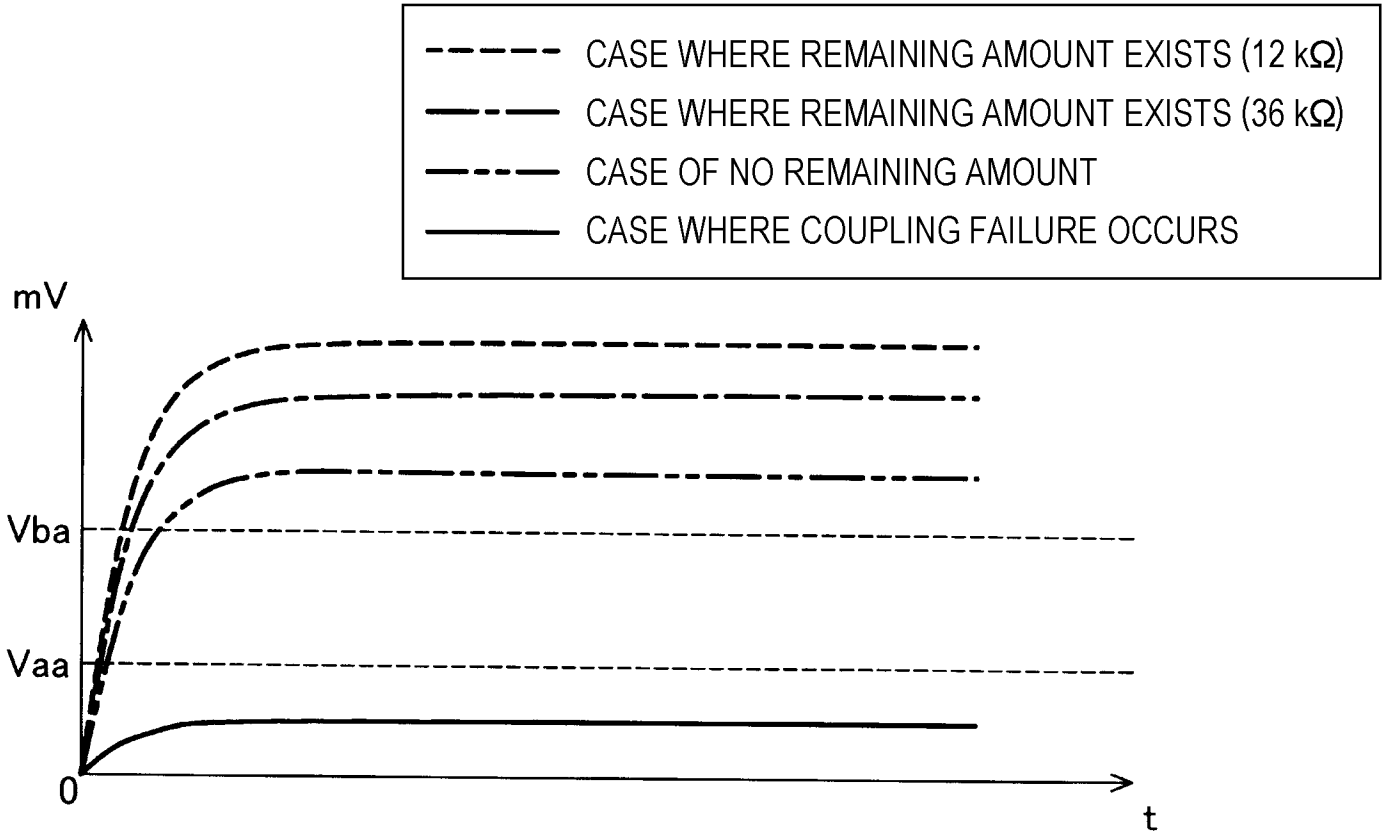
FIG. 9 is a diagram illustrating a simulation result of a detection output at a measurement point.

FIG. 9 is a diagram illustrating a simulation result of the detection output 57 at the measurement point MP. As illustrated in FIG. 9, the detection output 57 that is a voltage at the measurement point MP in a case where the remaining amount exists, that is, in a state where the first electrode 35 and the second electrode 36 are immersed in the liquid 34 is higher than that in a case of no remaining amount, that is, in a state where the liquid level is at a lower side than the first electrode 35. In the case where the remaining amount exists, the resistance when the second resistance value RV2 of the liquid 34 takes the maximum value is 36 kΩ. Further, the detection output 57 that is a voltage at the measurement point MP in the case of no remaining amount is higher than that in a case where a coupling failure of the electrode unit 37 occurs.

Based on the simulation result, a first threshold value Vaa and a second threshold value Vba are determined in advance. The first threshold value Vaa is a threshold value that is used to determine whether or not a coupling failure of the electrode unit 37 occurs. The second threshold value Vba is a threshold value that is used to determine whether or not the liquid exists in the liquid container 30. The second threshold value Vba is larger than the first threshold value Vaa. The first threshold value Vaa and the second threshold value Vba are stored, for example, in a memory in the control unit 16. The determination unit 161 compares the detection output 57 with the first threshold value Vaa to determine whether or not the coupling failure of the electrode unit 37 occurs. Specifically, the determination unit 161 determines that the coupling failure has occurred when the detection output 57 is smaller than the first threshold value Vaa, and determines that the coupling failure has not occurred when the detection output 57 is larger than the first threshold value Vaa. Further, the determination unit 161 compares the detection output 57 with the second threshold value Vba to determine whether or not the liquid exists in the liquid container 30. Specifically, the determination unit 161 determines that the liquid exists in the liquid container 30 when the detection output 57 is smaller than the second threshold value Vba, and determines that there is no liquid in the liquid container 30 when the detection output 57 is smaller than the second threshold value Vba and is larger than the first threshold value Vaa. The determination whether or not the coupling failure occurs is performed, for example, when the liquid 34 is refilled from the filling port 32 of the liquid container 30 or before the liquid ejecting apparatus 1 is shipped. Note that the determination whether or not the liquid exists is performed at a predetermined timing, for example, at the end of a printing job or the like.

According to the second embodiment, by providing the first capacitor C1 between the first electrode 35 and the second electrode 36, the resistance value between the first electrode 35 and the second electrode 36 can be made different between the case where the amount of the liquid decreases to the extent lower than the first electrode 35 and the case where the coupling failure of the electrode unit 37 occurs. Accordingly, the determination unit 161 can determine whether or not the coupling failure occurs and whether or not the liquid exists according to the difference in resistance value between the first electrode 35 and the second electrode 36. Specifically, the detection output 57 that is the voltage at the measurement point MP also changes when the resistance value between the first electrode 35 and the second electrode 36 changes. Accordingly, the determination unit 161 can determine whether or not the coupling failure of the electrode unit 37 occurs by comparing the voltage at the measurement point MP with the first threshold value Vaa, and can determine whether or not the liquid exists by comparing the voltage at the measurement point MP with the second threshold value Vba. Further, when the coupling failure of the electrode unit 37 is determined, it is not necessary to dispose another element, for example, a dummy resistor, and thus a determination period of time can be shortened. Alternatively, since it is not necessary to consider a space in which another element is disposed, the degree of freedom in design of the liquid ejecting apparatus 1*a* is improved. Additionally, according to the second embodiment described above, the liquid container 30 has the filling port 32. Accordingly, even when the liquid ejecting apparatus 1*a* is used for a long period of time, such as when the liquid is refilled from the filling port 32, the determination unit 161 can accurately determine whether or not the coupling failure of the electrode unit 37 occurs and whether or not the liquid exists.

C. Other Embodiments

C-1. Another Embodiment 1

In the respective embodiments described above, the liquid ejecting apparatuses 1 and 1*a* including the liquid containers 30 that contain ink as liquid have been described as examples, but the technique of the present disclosure can be applied to a liquid container that contains liquid other than ink, and a liquid ejecting apparatus including the liquid container. For example, the technique of the present disclosure can be applied to the following liquid ejecting apparatuses other than printers:

1. Image recording apparatuses such as facsimile apparatuses;
2. Coloring material ejecting recording apparatuses to be used in manufacturing color filters for image display apparatuses such as liquid crystal displays;
3. Electrode material ejecting apparatuses to be used for electrode formation of organic electro luminescence (EL) displays, field emission displays (FED), and the like;
4. Liquid ejecting apparatuses configured to eject liquid containing a bioorganic substance to be used in manufacturing biochips;
5. Sample ejecting apparatuses as precision pipettes;
6. Ejecting apparatuses of lubricating oil;
7. Ejecting apparatuses of resin liquid;
8. Liquid ejecting apparatuses that consume lubricating oil in a pinpoint manner to precision machines such as clocks or watches, and cameras;
9. Liquid ejecting apparatuses that eject transparent resin liquid such as ultraviolet-curing resin liquid onto substrates in order to form micro-hemispherical lenses (optical lenses) and the like to be used for optical communication elements and the like;
10. Liquid ejecting apparatuses that eject acidic or alkaline etching liquid in order to etch substrates and the like; and
11. Liquid ejecting apparatuses including liquid ejecting heads that eject any other kinds of droplets in a minutely small amount.

C-2. Another Embodiment 2

In each of the above-described embodiments, the arrangement of the first resistor R1 and the first capacitor C1 is not limited to that in each of the above-described embodiments as long as the first resistor R1 and the first capacitor C1 are provided between the first electrode 35 and the second electrode 36 on the electric circuit. For example, the first resistor R1 and the first capacitor C1 may be provided on the circuit substrate 26. Also in this case, each of the first resistor R1 and the first capacitor C1, and the second resistor R2 formed by the liquid 34 are coupled between the first electrode 35 and the second electrode 36 in a parallel manner.

D. Other Aspects

The present disclosure is not limited to the above-described embodiments, and can be implemented in various aspects without departing from the gist thereof. For example, the present disclosure can also be implemented by the following aspects. The technical features in the above-described embodiments corresponding to technical features in respective aspects to be described below can be appropriately replaced or combined in order to solve some or all of the problems of the present disclosure or in order to achieve some or all of the effects of the present disclosure. Further, when the technical features are not described as essential in this specification, they can be deleted as appropriate.

According to one aspect of the present disclosure, there is provided a liquid ejecting apparatus configured to eject liquid. The liquid ejecting apparatus includes an electrode unit that is provided in a liquid container configured to contain the liquid and that includes a first electrode and a second electrode, a determination unit configured to individually determine whether or not a coupling failure occurs in the electrode unit and whether or not the liquid exists in the liquid container, a first resistor being provided between the first electrode and the second electrode and having a first resistance value, and a second resistor having a second resistance value that varies depending on an amount of the liquid between the first electrode and the second electrode. According to this aspect, by providing the first resistor between the first electrode and the second electrode, the resistance value between the first electrode and the second electrode can be made different between a case where the amount of the liquid becomes small and a case where the coupling failure of the electrode unit occurs. Accordingly, the determination unit can determine whether or not the coupling failure occurs and whether or not the liquid exists according to the difference in resistance value between the first electrode and the second electrode.

In the aspect described above, the first resistance value may be larger than a maximum value of the second resistance value. According to this aspect, the resistance value between the first electrode and the second electrode can be made more largely different between the case where the coupling failure occurs in the electrode unit and the case where the amount of the liquid becomes small. Accordingly, the determination unit can determine whether or not the coupling failure occurs and whether or not the liquid exists with high accuracy according to the difference in resistance value between the first electrode and the second electrode.

In the aspect described above, the determination unit may determine whether or not the coupling failure of the electrode unit occurs by comparing a voltage at a measurement point provided between the determination unit and both the first resistor and the second resistor with a predetermined first threshold value, and may determine whether or not the liquid exists by comparing the voltage at the measurement point with a predetermined second threshold value. According to this aspect, whether or not the coupling failure of the electrode unit occurs can be determined by comparing the voltage at the measurement point with the first threshold value, and whether or not the liquid exists can be determined by comparing the voltage at the measurement point with the second threshold value.

In the aspect described above, the second threshold value may be larger than the first threshold value. According to this aspect, by setting the second threshold value to be larger than the first threshold value, whether or not the coupling failure of the electrode unit occurs and whether or not the liquid exists in the liquid container can be determined.

According to another aspect of the present disclosure, there is provided a liquid ejecting apparatus configured to eject liquid. The liquid ejecting apparatus includes an electrode unit that is provided in a liquid container configured to contain the liquid and that includes a first electrode and a second electrode, a determination unit configured to determine whether or not a coupling failure occurs in the electrode unit and whether or not the liquid exists in the liquid container, a first capacitor provided between the first electrode and the second electrode, and a second resistor having a second resistance value that varies depending on an amount of the liquid between the first electrode and the second electrode. According to this aspect, by providing the first capacitor between the first electrode and the second electrode, the resistance value between the first electrode and the second electrode is made different between the case where the amount of the liquid becomes small and the case where the coupling failure of the electrode unit occurs. Accordingly, the determination unit can determine whether or not the coupling failure occurs and whether or not the liquid exists according to the difference in resistance value between the first electrode and the second electrode.

In the aspect described above, the determination unit may determine whether or not the coupling failure of the electrode unit occurs by comparing a voltage at a measurement point provided between the determination unit and both the second resistor and the first capacitor with a predetermined first threshold value, and may determine whether or not the liquid exists by comparing the voltage at the measurement point with a predetermined second threshold value. According to this aspect, whether or not the coupling failure of the electrode unit occurs can be determined by comparing the voltage at the measurement point with the first threshold value, and whether or not the liquid exists can be determined by comparing the voltage at the measurement point with the second threshold value.

In the aspect described above, the second threshold value may be larger than the first threshold value. According to this aspect, by setting the second threshold value to be larger than the first threshold value, whether or not the coupling failure of the electrode unit occurs and whether or not the liquid exists in the liquid container can be determined.

In the aspect described above, the liquid container may have a filling port through which the liquid is configured to be filled. According to this aspect, in the liquid ejecting apparatus having the liquid container provided with the filling port, the determination unit can determine whether or not the coupling failure occurs and whether or not the liquid exists.

The present disclosure can be implemented as aspects of a manufacturing method of a liquid ejecting apparatus, a determining method of a coupling failure and a remaining amount of liquid, a computer program configured to execute the determining method, and the like, in addition to the above-described aspects.

What is claimed is:

1. A liquid ejecting apparatus configured to eject liquid, the liquid ejecting apparatus comprising:

an electrode unit that is provided in a liquid container configured to contain the liquid and that includes a first electrode and a second electrode;

a determination unit configured to individually determine whether or not a coupling failure of the electrode unit occurs and whether or not the liquid exists in the liquid container;

a first resistor that is provided between, and is in direct contact with, the first electrode and the second electrode, the first resistor having a first resistance value; and a second resistor located inside the liquid container and having a second resistance value that varies depending on an amount of the liquid between the first electrode and the second electrode.

2. The liquid ejecting apparatus according to claim 1, wherein the first resistance value is larger than a maximum value of the second resistance value.

3. The liquid ejecting apparatus according to claim 1, wherein the determination unit determines whether or not the coupling failure of the electrode unit occurs by comparing a voltage at a measurement point provided between the determination unit and both the first resistor and the second resistor with a predetermined first threshold value, and determines whether or not the liquid exists by comparing the voltage at the measurement point with a predetermined second threshold value.

4. The liquid ejecting apparatus according to claim 3, wherein the second threshold value is larger than the first threshold value.

5. The liquid ejecting apparatus according to claim 1, wherein the liquid container has a filling port through which the liquid is configured to be filled.

6. A liquid ejecting apparatus configured to eject liquid, the liquid ejecting apparatus comprising:

an electrode unit that is provided in a liquid container configured to contain the liquid and that includes a first electrode and a second electrode;

a determination unit configured to determine whether or not a coupling failure of the electrode unit occurs and whether or not the liquid exists in the liquid container;

a first capacitor that is provided between, and is in direct contact with, the first electrode and the second electrode; and a second resistor located inside the liquid container and having a second resistance value that varies depending on an amount of the liquid between the first electrode and the second electrode.

7. The liquid ejecting apparatus according to claim 6, wherein the determination unit determines whether or not the coupling failure of the electrode unit occurs by comparing a voltage at a measurement point provided between the determination unit and both the second resistor and the first capacitor with a predetermined first threshold value, and determines whether or not the liquid exists by comparing the voltage at the measurement point with a predetermined second threshold value.

8. The liquid ejecting apparatus according to claim 7, wherein the second threshold value is larger than the first threshold value.

* * * * *